US008770443B2

(12) United States Patent
Bunoz et al.

(10) Patent No.: US 8,770,443 B2
(45) Date of Patent: Jul. 8, 2014

(54) FOAM PUMP

(75) Inventors: Etienne Vincent Bunoz, Hailsham (GB); Jeremy Rossall, East Preston (GB)

(73) Assignee: Brightwell Dispensers Limited, Newhaven (GB)

( * ) Notice: Subject to any disclaimer, the term of this patent is extended or adjusted under 35 U.S.C. 154(b) by 0 days.

(21) Appl. No.: 13/387,638

(22) PCT Filed: Jun. 15, 2010

(86) PCT No.: PCT/GB2010/001174

§ 371 (c)(1), (2), (4) Date: May 9, 2012

(87) PCT Pub. No.: WO2011/012836

PCT Pub. Date: Feb. 3, 2011

(65) Prior Publication Data

US 2012/0217267 A1 Aug. 30, 2012

(30) Foreign Application Priority Data

Jul. 29, 2009 (GB) ..... 0913221.8

(51) Int. Cl.

| | |
|---|---|
| ***B67D 7/76*** | (2010.01) |
| ***B05B 11/00*** | (2006.01) |
| ***B05B 7/00*** | (2006.01) |

(52) U.S. Cl.

CPC ..... *B05B 11/3087* (2013.01); *B05B 7/005* (2013.01); *B05B 7/0062* (2013.01)

USPC ..... 222/190; 222/321.7

(58) Field of Classification Search

CPC .. B05B 11/3087; B05B 7/005; B05B 7/0062; B05B 7/0018

USPC ..... 222/190, 340, 341, 145.5, 321.1, 321.7, 222/321.9, 383.1, 384

See application file for complete search history.

(56) References Cited

U.S. PATENT DOCUMENTS

| | | | | |
|---|---|---|---|---|
| 4,324,348 | A | 4/1982 | Johnson et al. | |
| 5,033,654 | A * | 7/1991 | Bennett | 222/190 |
| 5,779,104 | A * | 7/1998 | Reidel | 222/190 |
| 5,862,954 | A * | 1/1999 | Ehrensperger et al. | 222/190 |
| 6,409,050 | B1 | 6/2002 | Ophardt et al. | |
| 6,626,332 | B2 * | 9/2003 | Ehrensperger et al. | 222/190 |
| 7,051,903 | B2 | 5/2006 | Lewis et al. | |
| 7,063,239 | B2 * | 6/2006 | Niada | 222/383.1 |

(Continued)

FOREIGN PATENT DOCUMENTS

| | | |
|---|---|---|
| EP | 0 019 582 | 11/1980 |
| EP | 0 392 238 | 10/1990 |

(Continued)

*Primary Examiner* — Lien Ngo
(74) *Attorney, Agent, or Firm* — Levy & Grandinetti

(57) ABSTRACT

A foam pump is disclosed which includes a fluid cylinder, an air cylinder, and a mixing chamber. The mixing chamber includes a fluid throughflow axis, a fluid inlet and an air inlet. The fluid cylinder and the air cylinder both include a stroke axis which is substantially normal to the fluid throughflow axis. The fluid cylinder is adapted to draw a fluid therein in a priming stroke and to pump the fluid into the mixing chamber through the fluid inlet in a dispensing stroke. The air cylinder is adapted to draw air therein in a priming stroke and to pump the air into the mixing chamber through the air inlet in a dispensing stroke. The fluid inlet and the air inlet face in substantially opposite directions.

20 Claims, 3 Drawing Sheets

(56) References Cited

U.S. PATENT DOCUMENTS

| | | | | |
|---|---|---|---|---|
| 8,002,151 | B2 | 8/2011 | Matthews et al. | |
| 8,430,273 | B2 * | 4/2013 | Brouwer | 222/190 |
| 2006/0273114 | A1 * | 12/2006 | Ophardt | 222/321.1 |
| 2009/0039110 | A1 * | 2/2009 | Brouwer | 222/190 |
| 2009/0062176 | A1 * | 3/2009 | Seidling et al. | 510/406 |
| 2009/0255957 | A1 * | 10/2009 | Mizushima et al. | 222/190 |
| 2010/0314417 | A1 * | 12/2010 | Lee | 222/190 |

FOREIGN PATENT DOCUMENTS

| | | |
|---|---|---|
| EP | 0 613 728 | 9/1994 |
| EP | 1 118 389 | 7/2001 |
| EP | 1 266 696 | 12/2002 |
| EP | 2 080 464 | 7/2009 |
| FR | 6 641 337 | 7/1990 |
| GB | 2 155 435 | 9/1985 |
| GB | 2 193 904 | 2/1988 |
| GB | 2 362 340 | 11/2001 |
| WO | WO 95/26831 | 10/1995 |
| WO | WO 97/13585 | 4/1997 |
| WO | WO 99/49769 | 10/1999 |
| WO | WO03/059524 | 7/2003 |
| WO | WO 2004/044534 | 5/2004 |
| WO | WO 2005/105320 | 11/2005 |

* cited by examiner

FOAM PUMP

This application is the U.S. National Phase of International Application No. PCT/GB2010/001174 filed on Jun. 15, 2010, which claims priority to Great Britain Application No. 0913221.8 filed on Jul. 29, 2009.

The present invention relates to a foam pump, for use particularly, but not exclusively, to generate foamed soap products from a liquid soap and air.

Foam pumps are well known, and comprise separate fluid and air cylinders adapted to force a subject liquid and air together inside a mixing chamber. The co-mingled liquid and air is then forced over one or more foaming meshes, before being dispensed from a nozzle. The liquid is drawn from a cartridge to which the pump is attached, and air is drawn from atmosphere, either through the nozzle or from an inlet elsewhere on the device.

In many cases the fluid and air cylinders are co-axial, which is to say one is arranged inside the other on the same axis. Most pumps are constructed about a fluid throughflow axis, with a fluid inlet, mixing chamber, foaming chamber and fluid outlet arranged sequentially on said axis, and with the co-axial fluid and air cylinders also arranged on said axis, either sequentially or radially in relation to the other features.

Such pumps are manually operated by a plunger part, depression of which forces the fluid and air cylinders to perform a dispensing stroke in unison, which forces fluid and air therein into the mixing chamber, through into the foaming chamber and then out of the nozzle. A return spring is provided somewhere on the pump, or on the dispensing device with which it is used, which forces the fluid and air cylinders to perform a priming stroke in unison, which draws fluid and air therein, ready for the dispensing stroke.

Typical examples of such foam pumps are shown in EP0613728 to Daiwa Can Company, EP0703831 to Sprintvest Corporation N. V., EP0853500 to Park Towers International B. V., EP0984715 to DEB IP Limited, EP1266696 to Taplast S.p.A., EP1444049 to Bentfield Europe B.V., WO 2004/044534 to Continental AFA Dispensing Company, WO 2005/105320 to Airspray N.V., and U.S. Pat. No. 6,409,050 and GB2362340 to Ophardt.

In all of the above cases, because the fluid and air cylinders are arranged on the fluid throughflow axis, the plunger part also moves back and forth along said axis. This is appropriate when the pump is located at the top of a container of fluid, and is operated by a downward push on the operating plunger, but it is not particularly suitable for use inside a wall mounted dispensing device which dispenses foam from an underside thereof. Such dispensers are commonly operated by lateral movement of a cover or trigger, which movement is substantially normal to the fluid throughflow axis of the pump mounted underneath the container of fluid.

In EP0703831 to Sprintvest Corporation N. V., EP0984715 to DEB IP Limited and U.S. Pat. No. 6,409,050 to Ophardt, the pumps are arranged inside wall-mounted dispensers underneath containers of fluid mounted therein, and in order to deal with the vertical alignment of the fluid throughflow axis of the pump a special spring-loaded trigger is provided in each case, which converts a lateral movement into a vertical one to operate the pump. These constructions are not ideal because the transmission of the lateral movement of the trigger into a vertical one is not well controlled, leading to an adverse twisting of the pump which results in leakages and failures. Further, these constructions comprise an excess of independent parts, which adds costs.

EP1444049 to Bentfield Europe B.V. provides a slightly different solution, by arranging the pump at an angle to vertical, but this is also not ideal because it increases the size of the wall-mounted dispensing device.

Therefore, a first object of the present invention is to provide a foaming pump which overcomes some of the above problems and is more suitable for use in a wall-mounted dispenser.

With any foam pump, it is necessary to force the fluid and air together to create a mixture which is then forced over one or more foaming meshes to create the foam. The more thorough the mixing the better the resulting foam may be.

In addition, if a foam pump is mounted to the underside of a fluid container in a wall-mounted dispenser, it can suffer from leakage if the fluid and air are not thoroughly mixed. In particular, known foaming meshes naturally resist the flow of unmixed fluid therethrough due to the very small size of the through holes and the surface tension of the fluid, however they are only capable of holding back a particular height of unmixed fluid. Therefore, if a greater height of unmixed fluid remains inside the mixing chamber after a dispensing stroke, some of it can pass through the meshes and leak from the dispenser. This can occur, for example, if air is injected laterally into the mixing chamber below the fluid inlet, and after a dispensing stroke unmixed fluid remains in the mixing chamber above the air inlet.

In the prior art devices referred to above the fluid and air are mixed together in a variety of ways. In EP1266696 to Taplast S.p.A., EP1444049 to Bentfield Europe B.V., WO 2004/044534 to Continental AFA Dispensing Company, and WO 2005/105320 to Airspray N.V., the fluid and air are both pumped into the mixing chamber in the same fluid throughflow direction. This results in a low degree of mixing which produces an inferior foam, and which leaves a body of unmixed fluid inside the mixing chamber after a dispensing stroke.

However, in EP0613728 to Daiwa Can Company, the air enters the mixing chamber at 90 degrees to the flow of fluid therethrough. This results in a more efficient co-mingling effect of the fluid and air, because turbulence is generated between the two substances. (The same arrangement is provided in another prior art form pump shown in GB2193904 to Ballard Medical Products.) EP0853500 to Park Towers International B. V., also has a similar arrangement, but in that case the foaming mesh is directly adjacent to where the fluid and air mix, which negates any reasonable degree of mixing. In EP0703831 to Sprintvest Corporation N. V. and U.S. Pat. No. 6,409,050 and GB2362340 to Ophardt, the opposite arrangement is provided, with the fluid forced into the mixing chamber at 90 degrees to the path of air therethrough. Again this provides an advantageous co-mingling effect. However, the mixing effect in these documents is still not optimal, and in some cases would still result in a body of unmixed fluid remaining in the mixing chamber after a dispensing stroke.

This concept is taken a step further in EP0984715 to DEB IP Limited, in which the fluid is forced into the mixing chamber in generally the opposite direction to the air. This is achieved by having an inlet pipe arranged on the fluid through flow axis and in the direction of fluid flow of the pump generally, the open end of which is fitted with a top-hat valve. Therefore the flow of fluid through the inlet pipe is reversed when it reaches the top-hat valve, and it is fed into the path of air travelling down the outside of the inlet pipe. This results in a greater degree of turbulence and co-mingling of the fluid and air. However, this arrangement is specifically adapted for a foam pump in which all the parts are arranged on the fluid throughflow axis, and it also suffers from the disadvantage that when the top-hat valve is open in use it disrupts the flow of co-mingled fluid and air out of the mixing chamber, and actually urges it in the opposite direction. As the fluid inlet is effectively inverted no unmixed fluid is left in the mixing chamber after a dispensing stroke, but inverting the fluid inlet in this way adds considerable complexity to the foam pump, and does not allow for the fluid to enter the mixing chamber from above, which is desirable because it assists with the flow of fluid through the foam pump generally.

In all of the examples given above, the mixing chamber, if there is one to speak of, is cylindrical. As such, the shape of the mixing chamber has no role to play in the efficient co-mingling of the fluid and air pumped therein.

Therefore, a second object of the present invention is to overcome some of the above described problems, and to provide a more efficient pre-mixing of the fluid and air prior to being subjected to any foaming mesh, to improve the quality of the foam, and to prevent a body of unmixed fluid remaining in the mixing chamber after a dispensing stroke.

Therefore, according to the present invention a foam pump comprises a fluid cylinder, an air cylinder and a mixing chamber, in which the mixing chamber comprises a fluid throughflow axis, a fluid inlet and an air inlet, in which the fluid cylinder and the air cylinder both comprise a stroke axis which is substantially normal to said fluid throughflow axis, in which the fluid cylinder is adapted to draw a fluid therein in a priming stroke and to pump said fluid into said mixing chamber through said fluid inlet in a dispensing stroke, in which the air cylinder is adapted to draw air therein in a priming stroke and to pump said air into said mixing chamber through said air inlet in a dispensing stroke, and in which said fluid inlet and said air inlet face in substantially opposite directions.

Thus, the present invention provides a foaming pump in which an axis of operation of the fluid and air cylinders is normal to the fluid throughflow axis of the pump. As such, the pump of the present invention is suitable for use in a wall-mounted foam dispenser which dispenses foam from an underside thereof and is operated by lateral depression of the cover, because the fluid throughflow axis can be substantially vertical, while the operational axis of the fluid and air cylinders can be aligned with lateral movement of the cover.

(The term "substantially normal to" with regard to the relationship between the stroke axes of the fluid and air cylinders and the fluid throughflow axis is intended to include a range of 15 degrees or so either side of 90 degrees, so the invention includes a slight canting of the fluid through flow axis in relation to said stroke axes to allow for foam to be dispensed at a slight angle towards a user, and not directly downwards.)

In addition, the present invention also provides a foaming pump suitable for a wall-mounted dispenser, in which the fluid and air are pumped into the mixing chamber in different directions, which leads to an efficient co-mingling thereof, and in particular enough to provide a high quality foam, and to cause sufficient mixing and movement inside the mixing chamber to prevent any residue of unmixed fluid remaining therein after the dispensing stroke, which might leak therefrom.

In one embodiment of the invention, the mixing chamber can comprise a conical section. The purpose of this feature is to provide a high pressure area within the mixing chamber where the conical section decreases in volume, which can increase the mixing action and turbulence of the co-mingling fluid and air in use, and which can also be utilised to generate a movement of the fluid and air in a desired direction.

Preferably the fluid inlet can face in a fluid flow direction of the mixing chamber, and the air inlet can be arranged downstream of said fluid inlet and can face against said fluid flow direction. As such, the fluid and air entering the mixing chamber are forced into each other's path, creating a high degree of mixing action and turbulence. This also means that there is no body of unmixed fluid inside the mixing chamber above the air inlet, which could leak from the foam pump after the dispensing stroke.

The conical section can comprise a truncated cone with a cone axis thereof aligned with said fluid throughflow axis, and with a base thereof downstream of an apex thereof. Therefore, the conical section can be arranged in such a way that a high pressure area where it reduces in volume is configured such that it generally forces the mixed fluid and air inside the mixing chamber to travel in a downstream direction from its apex to its base. The fluid collides with the air, and a turbulent co-mingling occurs, which is increased in the region of the apex of the truncated cone, leading to the mixture being urged back in the fluid flow direction. This turbulent movement inside the mixing chamber ensures that all the mixed fluid and air is cleared out of the mixing chamber, further preventing any unmixed fluid remaining therein after the dispensing stroke.

In a preferred embodiment the fluid inlet can be provided with an inlet valve comprising a resilient cone member mounted on a boss, which cone member can comprise an outer rim, which can be urged against an inner surface of said mixing chamber to shut the fluid inlet by a negative pressure generated during a priming stroke of said fluid cylinder, and which can be forced away from said inner surface to open the fluid inlet by a positive pressure generated during a dispensing stroke of said fluid cylinder. An underside of this cone member can comprise said conical section of said mixing chamber. Therefore, the valve used to control the flow of fluid into the mixing chamber can have the dual function of controlling the flow of fluid into the mixing chamber, and also defining the advantageous conical shape inside the mixing chamber.

This configuration also means that the fluid enters the mixing chamber below the base of the truncated cone, which allows it to collide with the air, before travelling up into the truncated cone, which increases the degree of movement and agitation inside the mixing chamber.

The boss can be mounted on a sleeve component provided in said mixing chamber, and an aperture can be formed between said boss and said sleeve through which mixed air and fluid can pass in use.

This sleeve component can also provide for the air to be directed to the mixing chamber in the manner described above. In particular, the air cylinder can be connected to said mixing chamber by an air passageway which extends from a first opening at a bottom of said air cylinder to said air inlet of said mixing chamber. The air passageway can comprise a first portion which extends from said first opening to an intermediary opening in said inner surface of said mixing chamber. The sleeve component can overlie said intermediary opening, and it can comprise an annular trough in an outer surface thereof which can be aligned with said intermediary opening and can define a second portion of the air passageway. The sleeve component can then comprise a flat wasted section extending axially from said annular trough to an upper rim of said sleeve component, and defining a third portion of the air passageway. Therefore, the air enters the trough, travels around it in both directions to opposed openings where the wasted section begins, and then up the wasted section and into the mixing chamber where it collides with the fluid entering from above.

Preferably the foam pump can comprise a valve chamber provided with a primary fluid inlet and a primary fluid outlet, which can be arranged on said fluid throughflow axis. The valve chamber and the mixing chamber can be sequentially aligned on the fluid throughflow axis, and the fluid cylinder can be in operative connection with the valve chamber. Therefore, the primary fluid outlet of the valve chamber referred to here is the same feature as the fluid inlet of the mixing chamber.

Further, the primary fluid inlet can be controlled by a primary fluid valve member adapted to open during a priming stroke of said fluid cylinder and to shut during a dispensing stroke of said fluid cylinder. In a preferred construction the primary fluid valve member can be a ball valve.

With this construction the positive and negative pressure generated by the movement of the fluid piston in use acts on a single valve chamber in a simple and efficient construction.

It is possible for the fluid cylinder and the air cylinder to be arranged next to one another, but in a preferred construction the fluid cylinder and the air cylinder can be co-axial with one another. In one construction the air cylinder can be disposed inside the fluid cylinder, but in a preferred embodiment the air cylinder can be radially arranged around the fluid cylinder. This is suitable when the valve chamber and the mixing chamber are sequentially aligned on said fluid throughflow axis, as described above, because the air cylinder can conveniently be in operative connection with the mixing chamber, downstream of the valve chamber.

Preferably the fluid cylinder and the air cylinder can be provided with a common piston member comprising a fluid piston and an air piston, which can be co-axial with one another and be disposed in said fluid cylinder and said air cylinder respectively.

In an expedient embodiment of the invention, the fluid piston and air piston can be self-sealing against the walls of the fluid cylinder and air cylinder respectively. This is a simple construction which saves on separate sealing components, and can be readily achieved with modern materials.

It is possible for the air cylinder to draw air therein from an outlet nozzle of the pump, however, in a preferred construction the air cylinder can be provided with one or more apertures through which air from atmosphere can be drawn. These apertures can be provided with a primary air valve member adapted to open during a priming stroke of the air cylinder and to shut during a dispensing stroke thereof.

The one or more apertures can be provided at the bottom of the air cylinder, and the primary air valve member can comprise a resilient annular disc disposed at the bottom of the air cylinder, overlying the apertures. The disc can be lifted away from the bottom of the air cylinder to open the apertures by a negative pressure generated inside the air cylinder during a priming stroke thereof, and the disc can be urged against the bottom of the air cylinder to shut the apertures by a positive pressure generated inside the air cylinder during a dispensing stroke thereof.

The co-mingled fluid and air exiting the mixing chamber is not a foam, so as in known foam pumps a foaming chamber can be provided, which can be sequentially aligned on said fluid throughflow axis after the mixing chamber. The foaming chamber can comprise one or more foaming meshes adapted to generate a foam to be dispensed from the mixed air and fluid forced into the foaming chamber. In a preferred construction two spaced apart foaming meshes can be provided.

In one embodiment of the invention the pump can be provided without any return spring. Such a pump can find application with a dispenser which comprises an integral return spring, which is adapted to bias the piston member to perform a priming stroke in some way. This can be achieved with a spring loaded trigger like that shown in the prior art, or with another type of wall-mounted dispenser in which a cover thereof is attached to a base with a hinge, and is rotatable about said hinge towards and away from said base, and in which the cover is connected to the foam pump via a pivoting linkage adapted to convert the rotational movement of the cover into a linear movement of the operating plunger. In such an arrangement the piston member is operatively connected to the cover via this pivoting linkage. The pivoting linkage can take one of several different forms, but an expedient arrangement comprises a track provided on the cover, through which a ball-shaped sliding member associated with the piston member can travel in use.

However, in an alternative embodiment of the invention the foam pump can comprise spring means adapted to bias the common piston member to perform a priming stroke of the fluid cylinder and the air cylinder. With this arrangement the pump automatically performs a priming stroke after each dispensing stroke.

The spring means can be any known type of spring which is capable of acting to bias the piston member, including any type of extension or compression spring external of the fluid or air cylinder, or any such spring inside the foam pump acting on the active surfaces of the fluid or air pistons. However, in a preferred construction the spring means can comprise a coil spring disposed in the air cylinder and around the fluid cylinder, which can act against said air piston.

A foam pump with its own return spring can be used with any type of dispenser, but in one construction it can be adapted to be used with a wall-mounted dispenser which is operated by generally lateral movement of a cover thereof. Therefore the piston member can comprise an operating plunger provided with an operative depression surface at an outer end thereof. The inside surface of the cover of a dispenser like that described above can bear against the operative surface when it is depressed, in order to operate the pump. The action of the spring can then push the operative surface back out again, returning the cover of the dispenser to its starting position.

Alternatively, if the foam pump comprises no return spring and is intended to be used with a wall-mounted dispenser in which the cover rotates in relation to the base, and is connected to the foam pump via a pivoting linkage comprising a track provided on the cover, through which a ball-shaped sliding member associated with the piston member can travel in use, then the piston member can comprise an operating plunger provided with a substantially ball-shaped resilient sliding member at an outer end thereof.

The invention can be performed in various ways, but three embodiments will now be described by way of example, and with reference to the accompanying drawings, in which.

Figure 1:
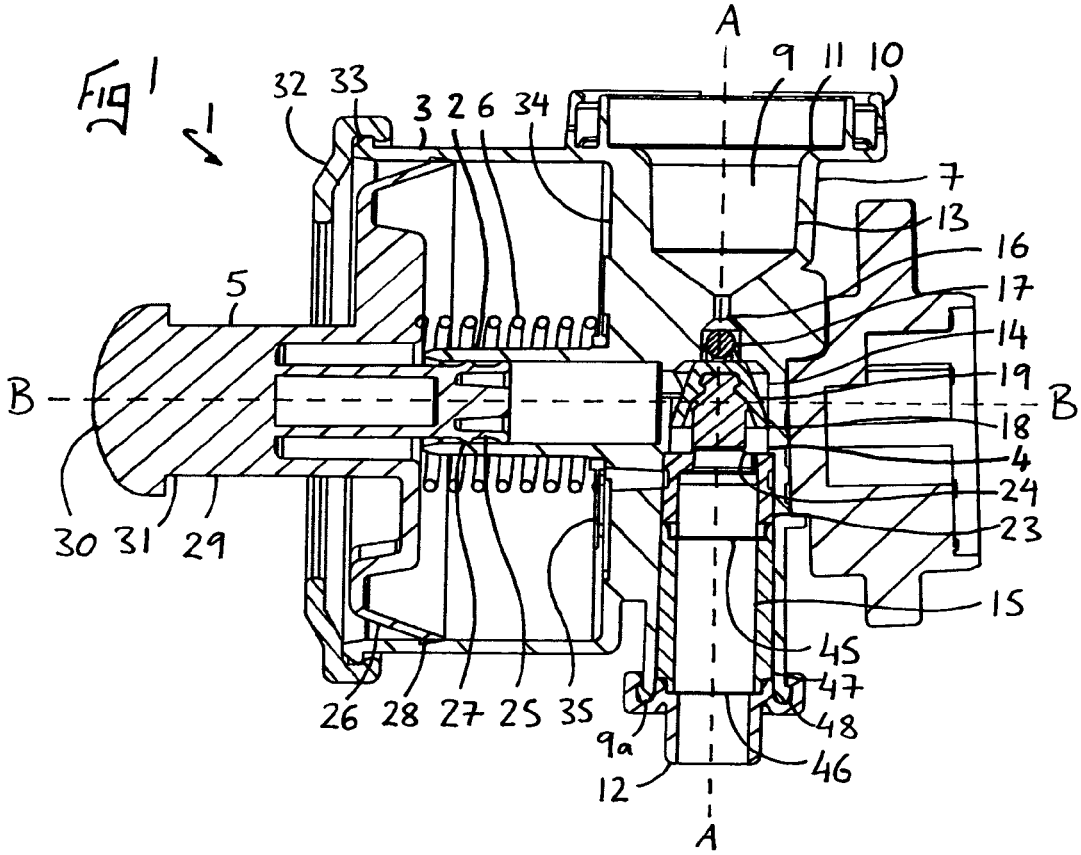
FIG. 1 is a cross-sectional side view of a first foam pump according to the invention.

As shown in FIG. 1, a foam pump 1 comprises a fluid cylinder 2, an air cylinder 3, and a mixing chamber 4. The mixing chamber 4 comprises a fluid throughflow axis A-A, a fluid inlet 18 and an air inlet 44 (visible in FIG. 3). The fluid cylinder 2 and the air cylinder 3 both comprise a stroke axis B-B which is substantially normal to said fluid throughflow axis A-A. As described further below, the fluid cylinder 2 is adapted to draw a fluid therein in a priming stroke, and to pump said fluid into said mixing chamber 4 in a dispensing stroke, and the air cylinder 3 is adapted to draw air therein in a priming stroke, and to pump said air into said mixing chamber 4 in a dispensing stroke. As is clear from the Figures, said fluid inlet 18 and said air inlet 44 face in substantially opposite directions.

The foam pump 1 comprises a body 7 with a bore 9 arranged on the axis A-A. A container coupling 10 is provided at a first end 11 of the bore 9, and an outlet nozzle component 12 is attached to a second end 9*a* of the bore 9. Arranged sequentially in the bore 9 is a fluid inlet funnel 13, a valve chamber 14, the mixing chamber 4, and a foaming chamber 15.

The fluid cylinder 2 and the air cylinder 3 are co-axial with one another and are aligned on the stroke axis B-B. The fluid and air cylinders 2 and 3 are integrally formed as a part of the body 7, and as is clear from FIG. 1, the fluid cylinder 2 is arranged inside the air cylinder 3, and is aligned, and in operative connection with, the valve chamber 14. The air cylinder 3 is in operative connection with the mixing chamber 4, downstream of the valve chamber 14, as described further below.

Figure 2:
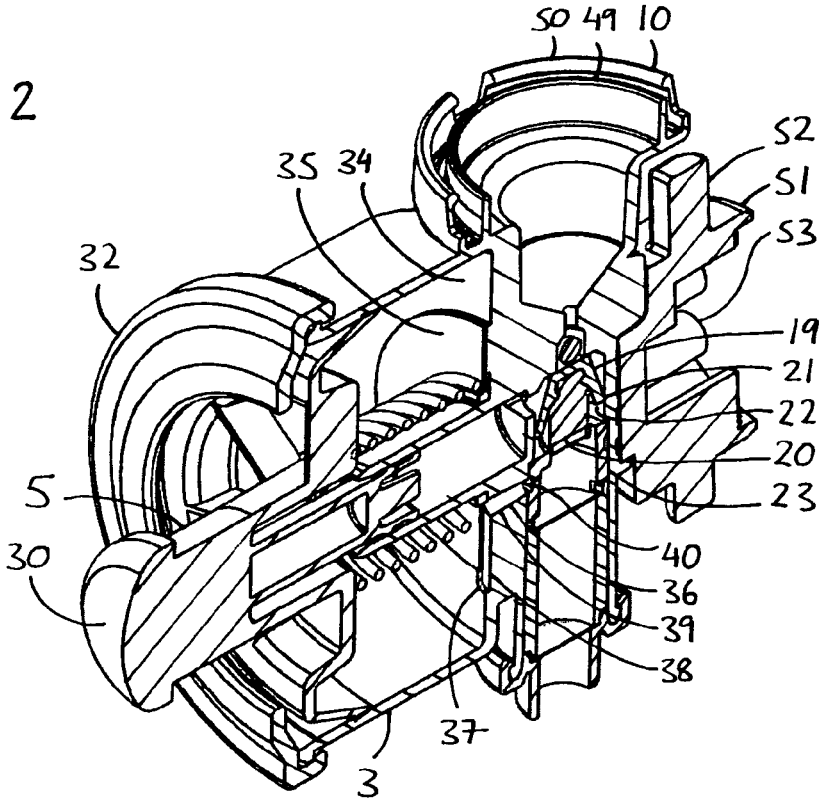
FIG. 2 is a cross-sectional perspective view of the first foam pump as shown in FIG. 1.

The valve chamber 14 is provided with a primary fluid inlet 16 controlled by ball valve 17, and a primary fluid outlet, being the same part as the fluid inlet 18 into the mixing chamber 4. The fluid inlet 18 is provided with an inlet valve comprising resilient cone member 19. Referring to FIG. 2, the cone member 19 is mounted on a boss 20 and comprises an outer rim 21, which is urged against an inner surface 22 of the mixing chamber 4 to shut the fluid inlet 18 by negative pressure generated during a priming stroke of the fluid cylinder 2, and which is lifted away from the inner surface 22 to open the fluid inlet 18 by a positive pressure generated during a dispensing stroke of the fluid cylinder 2.

As is clear from the Figures, the foam pump 1 has a fluid flow direction in which fluid passes through the bore 9 from its first end 11 to its second end 9*a*. The fluid inlet 18 faces in this fluid flow direction, and the air inlet 44 is arranged downstream of the fluid inlet 18 and faces against the fluid flow direction.

Figure 3:
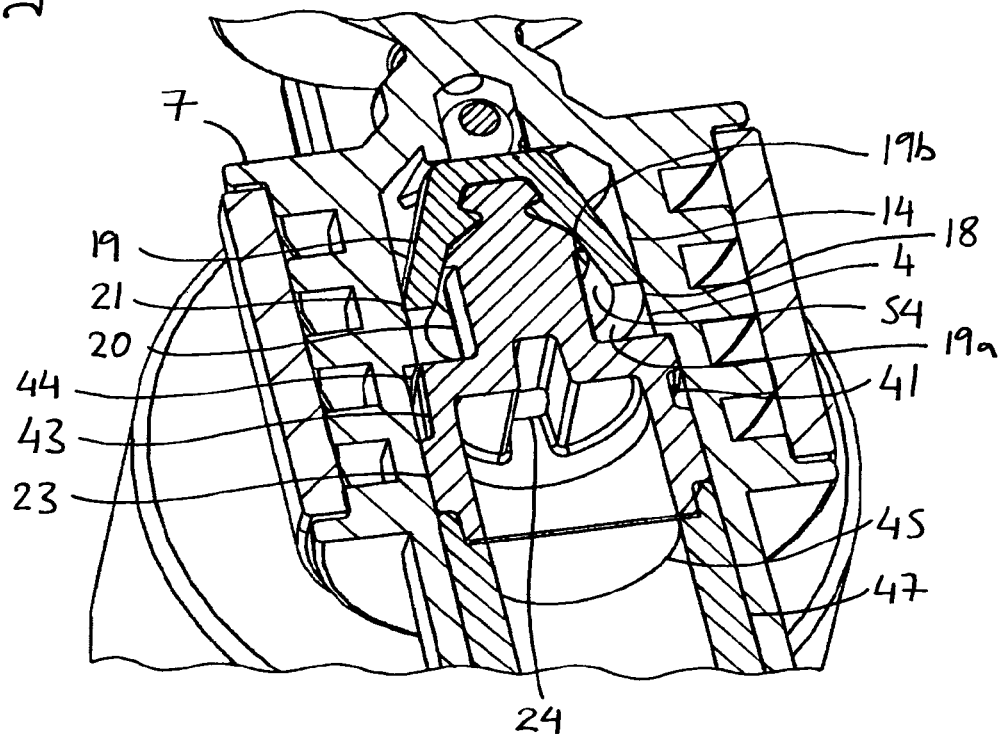
FIG. 3 is a cross-sectional perspective view of a part of the first foam pump as shown in FIG. 1.

Referring to FIG. 3, an underside of the cone member 19 provides the mixing chamber 4 with a conical section 54, in the form of a truncated cone with a cone axis thereof aligned with said fluid throughflow axis A-A, and with a base 19*a* thereof downstream of an apex 19*b* thereof. Therefore, the fluid inlet 18 is arranged below the conical section 54, and the air inlet 44 faces towards it.

The boss 20 is mounted on a sleeve component 23 disposed in the mixing chamber 4, and an aperture 24 is formed between the boss 20 and the sleeve 23, through which mixed fluid and air passes in use, as described further below.

The fluid cylinder 2 and the air cylinder 3 are provided with a common piston member 5, which comprises a fluid piston 25 and an air piston 26, which are both self-sealing against the fluid and air cylinders 2 and 3 respectively, by virtue of resilient flanges 27 and 28 in each case.

The piston member 5 has an operating plunger 29, which comprises an operative depression surface 30 at an outer end 31 thereof, which is adapted to co-operate with the inside surface of a dispensing device with which the foam pump 1 is used, as described further below. The piston member 5 is secured inside the fluid and air cylinders 2 and 3 by an annular end cap 32, fastened to the air cylinder 3 with a snap-fit coupling 33.

The air cylinder 3 is provided with four apertures (not visible) at a bottom 34 thereof, through which air from atmosphere can be drawn. A resilient annular disc 35 is disposed at the bottom 34 of the air cylinder 3, overlying the apertures. The disc 35 lifts away from the bottom 34 of the air cylinder 3 to open the apertures when a negative pressure is generated inside the air cylinder 3 during a priming stroke thereof, and the disc 35 is urged against the bottom 34 of the air cylinder 3 to shut the apertures when a positive pressure is generated inside said air cylinder 3 during a dispensing stroke thereof.

Referring to FIG. 2, the air cylinder 3 is connected to the mixing chamber 4 by an air passageway 36. This begins at a first opening 37 at the bottom 34 of the air cylinder 3, which opening 37 is radially located outside the disc 35. The opening 37 is a part of an elongate trough 38 which extends under the disc 35 to a bore 39 perpendicular thereto, which leads to an intermediary opening 40 in the inner surface 22 of the mixing chamber 4. As is clear from FIG. 2, the sleeve component 23 overlies this opening 40.

Figure 4:
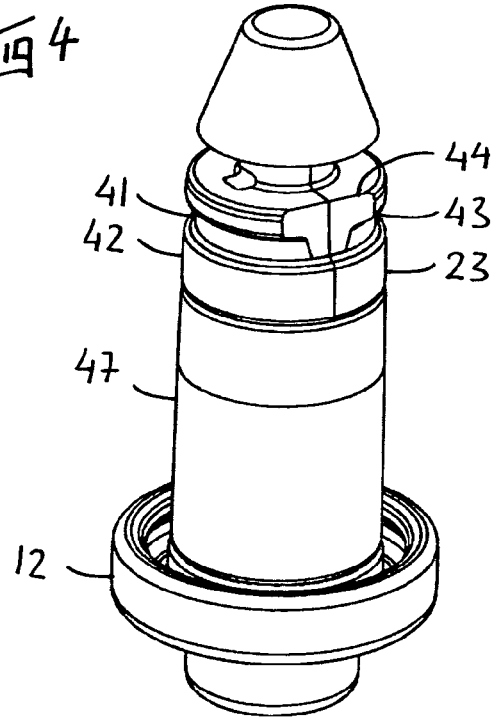
FIG. 4 is a perspective view of internal stacked components forming a part of the first foam pump as shown in FIG. 1.

Referring now to FIG. 4, which shows the sleeve component 23 and its axially associated parts in isolation, the sleeve component 23 comprises an annular trough 41 in an outer surface 42 thereof. As is clear from FIGS. 1 and 2, this trough 41 is aligned with the intermediary opening 40. The sleeve component 23 also comprises a flat wasted section 43 extending axially from the annular trough 41 to an upper rim 44 of the sleeve component 23.

As shown in FIG. 3, this wasted section 43 defines a passageway from the trough 41 to the air inlet 44 of the mixing chamber 4, which as described above faces in an opposite direction to the flow of fluid entering the mixing chamber 4 around the outer rim 21 of the cone member 19.

Referring back to FIG. 1, the foaming chamber 15 comprises two foaming meshes 45 and 46. The first mesh 45 is disposed between the sleeve component 23 and a mounting sleeve 47, while the second mesh 46 is disposed between the mounting sleeve 47 and the nozzle component 12. The nozzle component 12 is fastened to the body 7 with a snap-fit coupling 48, and this holds the second mesh 46, the mounting sleeve 47, the first mesh 45 and the sleeve component 23 in position inside the bore 9.

As shown in FIG. 1, coil spring 6 is disposed in the air cylinder 3, and around the fluid cylinder 2. It is a compression coil spring, which acts against the air piston 26 to bias the piston member 5 to perform a priming stroke. The coil spring 6 is mounted inside the foam pump 1 in a state of compression by the end cap 32, and it performs three functions: i) it works to hold the piston member 5 in an outermost position after a priming stroke, ii) it acts as a dampening means during the performance of a dispensing stroke, and iii) it acts as a return spring to urge the piston member 5 to perform a priming stroke.

The foam pump 1 shown in the Figures is adapted to co-operate with a container of soap to be dispensed. Referring to FIG. 2, the container coupling 10 is a snap-fit coupling comprising an annular boss 49 with four resilient part-annular arms 50 arranged around it (only two of which are visible in FIG. 2). The coupling 10 is adapted to fasten to a mounting boss provided on a container of soap (not shown). In this particular case, the foam pump 1 is disposable, and is intended to be supplied ready affixed to a container of soap, and disposed of when the container is spent.

The foam pump 1 is also provided with an annular mounting boss 51 which is clipped to its rear. This mounting boss 51 comprises a pair of bayonet locking pins 52 adapted to co-operate with a bayonet socket on a dispensing device to which it is intended to be mounted (not shown). The mounting boss 51 also comprises a shaped profile 53, which is adapted to co-operate with a corresponding shaped profile provided on the dispensing device. This feature is designed to prevent incorrect containers of soap being fitted to particular dispensers.

The foam pump 1 operates as follows. The pump 1 is mounted to the underside of a container of liquid soap to be dispensed (not shown), and affixed thereto by the coupling 10. A clear fluid passageway from the container is created, and the fluid inlet funnel 13 is flooded with liquid soap.

To prime the pump 1 the piston member 5 is driven by the coil spring 6 up the fluid and air cylinders 2 and 3. The negative pressure generated by the movement of the fluid piston 25 sucks soap from the fluid inlet funnel 13 into the valve chamber 14, through the primary fluid inlet 16. The ball valve 17 is drawn away from the primary fluid inlet 16 so it stays open. The negative pressure also urges the outer rim 21 of the cone member 19 against the inner surface 22 of the mixing chamber 4, so it stays shut. Soap floods the valve chamber 14 and is drawn into the fluid cylinder 2.

At the same time, the negative pressure generated by the movement of the air piston 26 lifts the resilient disc 35 off the bottom 34 of the air cylinder 3, and draws air therein.

The movement of the piston member 5 is arrested by the end cap 32, and the foam pump 1 is primed with liquid soap and air, ready to be mixed and dispensed as a foam.

The pump 1 is fitted in use inside a dispensing device comprising a base and a cover hinged thereto (not shown). The mounting boss 51 co-operates with a bayonet socket provided on the base, and the cover is applied in a floating manner to the operative surface 30 of the piston member 5. To perform a dispensing stroke the cover is depressed by the user, and it drives the piston member 5 down the fluid and air cylinders 2 and 3.

The positive pressure generated by the movement of the fluid piston 25 forces the soap from the fluid cylinder 2 and the valve chamber 14 into the mixing chamber 4, through the fluid inlet 18. The outer rim 21 of the cone valve 19 is lifted away from the inner surface 22 of the of the mixing chamber 4, creating an annular opening. The ball valve 17 is forced into the primary fluid inlet 16, so it shuts.

At the same time, the positive pressure generated by the movement of the air piston 26 forces the air therein into the mixing chamber 4, through the air passageway 36 and the air inlet 44. The air travels along the elongate trough 38, through the bore 39, before it enters the trough 41, travels around it in both directions and then goes up the wasted section 43. The disc 35 is urged against the bottom 34 of the air cylinder 3, so the air apertures are shut.

As referred to above, the air inlet 44 faces in the opposite direction to the flow of liquid soap entering the mixing chamber 4. As such, the air and liquid soap collide, and this leads to a thorough initial mixing of the two substances, at least in the region of the air inlet 44, which assists in the formation of high quality foam.

Further, the high degree of turbulence generated inside the mixing chamber 4 forces the soap and air to circulate thoroughly therein, which ensures that it efficiently clears out of the mixing chamber 4, preventing any unmixed soap from remaining therein after the dispensing stroke.

In addition, referring to FIG. 3, the shape of the conical section 54 of the mixing chamber 4 provided by the underside of the cone member 19 creates a high pressure area where the volume of the cone member 19 reduces adjacent to the boss 20. This high pressure area increases the mixing action and turbulence of the co-mingling soap and air, and as the high pressure area is at the opposite end of the mixing chamber 4 to the aperture 24, it urges the soap and air mixture to generally travel in the fluid flow direction and out through the aperture 24. This further assists in preventing any unmixed soap from remaining in the mixing chamber after the dispensing stroke.

It should be noted that the air inlet 44 is at 90 degrees to the stroke axis B-B, and that the aperture 24 is at 90 degrees to the air inlet 44, and is aligned with said stroke axis B-B at the opposite side of the mixing chamber 4 to the fluid cylinder 2. This configuration generates a degree of rotational flow inside the mixing chamber 4, because both the soap and the air have to travel around the boss 20 to reach the aperture 24. This also contributes to the beneficially high degree of movement and turbulence inside the mixing chamber, which thoroughly mixes the soap and air and ejects it all through the aperture 24.

The co-mingled liquid soap and air is forced by the combined pressure of the fluid and air pistons 25 and 26 through the aperture 24 into the foaming chamber 15. This pressure then forces the co-mingled soap and air over the two meshes 45 and 46, which turns the mixture into a foam. The generated foam then exits the pump 1 under pressure through the nozzle component 12, and drops into the hand or hands of the user.

Once the dispensing stroke has been completed and the user removes pressure from the cover of the dispenser, the foam pump 1 performs another automatic priming stroke as described above, loading the fluid and air cylinders 2 and 3 with liquid soap and air, and pushing the cover of the dispenser back out again.

As referred to above, at the end of the dispensing stroke a quantity of mixed soap and air remains inside the foaming chamber 15 and the mixing chamber 4, but any unmixed soap therein is not sufficient to pass over the foaming meshes 45 and 46 and leak from the foam pump 1, due to the efficient mixing effect described above.

Figure 5:
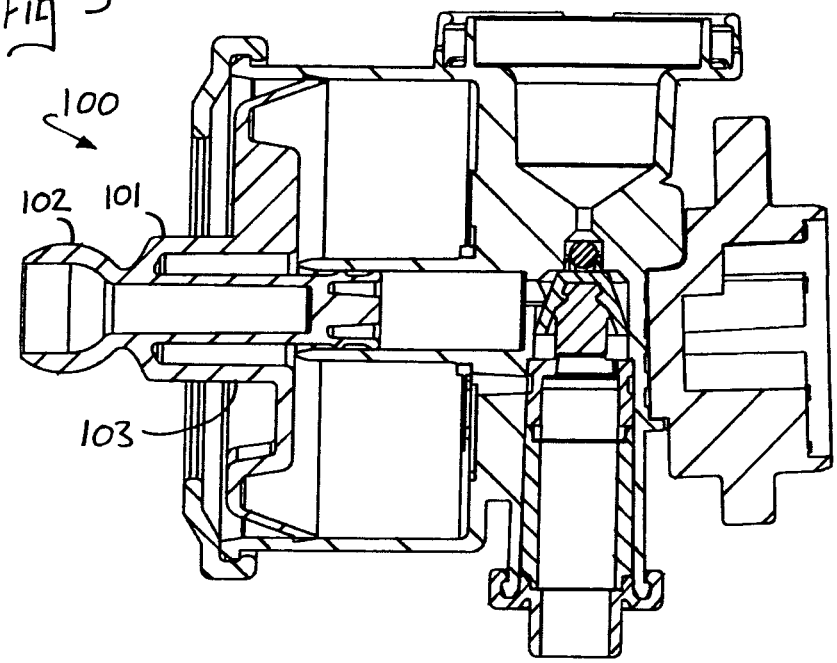
FIG. 5 is a cross-sectional side view of a second foam pump according to the present invention.

The above described embodiment can be altered without departing from the scope of claim 1. In particular, in one alternative embodiment shown in FIG. 5, a foam pump 100 is like foam pump 1 described above, except that it is adapted to be used with a particular type of wall-mounted dispenser, in which the cover thereof is attached to a base with a hinge, and is rotatable about said hinge towards and away from said base, and in which the cover is connected to the foam pump via a pivoting linkage adapted to convert the rotational movement of the cover into a linear movement of the operating plunger. The pivoting linkage comprises a track provided on the cover, through which a ball shaped sliding member can travel in use, and as such the operating plunger 101 comprises a substantially ball-shaped resilient sliding member 102 at an outer end thereof.

Of note is that foam pump 1 does not comprise any return spring, as the dispenser described above comprises its own return springs which act to return the cover to its starting position after it has been depressed. As the operating plunger 101 is fixed to the cover, the piston member 103 is made to automatically perform a priming stroke when the cover is forced back to its starting position.

Figure 6:
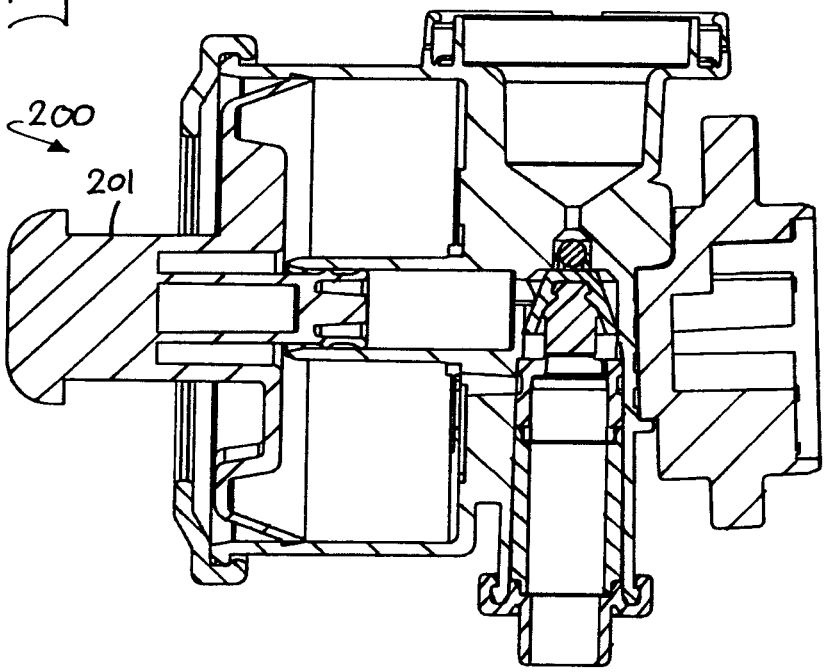
FIG. 6 is a cross-sectional side view of a third foam pump according to the present invention.

In another alternative embodiment shown in FIG. 6, a foam pump 200 is the same as foam pump 1 described above, except that it does not comprise any return spring. Foam pump 200 can find application with a dispenser which comprises an integral return spring, which is adapted to bias the operating plunger 201 to perform a priming stroke in some way. This can be achieved with a spring loaded trigger like those shown in the prior art and described above. The foam pump 200 could also be operated entirely manually, with the operating plunger being pushed in and pulled out by hand.

In other alternative embodiments (not shown) the spring means of the invention comprises other springs capable of acting to bias the piston member, including extension and compression springs external of the fluid or air cylinder, and a compression spring inside the fluid cylinder.

In another alternative embodiment (not shown) the fluid and air cylinders can not be co-axial, and instead can simply be arranged one next to the other on parallel stroke axes.

Some of the features forming a part of the foam pumps 1, 100 and 200 are not essential to the invention, and could be omitted, for example the container coupling 10 and mounting boss 51 which are specific to particular applications. Therefore, in other embodiments (not shown) these features are dispensed with, or replaced with other known soap container and/or dispenser interfaces.

Thus, the present invention provides a foam pump suitable for use inside a wall-mounted dispensing device, by virtue of the perpendicular arrangement of the fluid throughflow axis A-A and the co-axial fluid and air cylinders 2 and 3. In addition, the manner in which the air and soap collide and are moved and agitated under pressure inside the mixing chamber 4 leads to a high degree of premixing of the soap and air prior to foaming, which results in a high quality foam being produced, and which also ensures that no residue of unmixed soap is left inside the mixing chamber after each dispensing stroke, which prevents leakage.

The invention claimed is:

1. A foam pump comprising a fluid cylinder, an air cylinder and a mixing chamber, in which the mixing chamber comprises a fluid throughflow axis, a fluid inlet and an air inlet, in which the fluid cylinder and the air cylinder both comprise a stroke axis which is arranged at substantially 90 degrees to said fluid throughflow axis, namely, in a range of 15 degrees either side of 90 degrees thereto, in which the fluid cylinder is adapted to draw a fluid therein in a priming stroke and to pump said fluid into said mixing chamber through said fluid inlet in a dispensing stroke, in which the air cylinder is adapted to draw air therein in a priming stroke and to pump said air into said mixing chamber through said air inlet in a dispensing stroke, in which said fluid inlet faces in a fluid flow direction of the mixing chamber, and in which said air inlet is arranged downstream of said fluid inlet and faces in substantially the opposite direction against said fluid flow direction.

2. A foam pump as claimed in claim 1 in which said mixing chamber comprises a conical section.

3. A foam pump as claimed in claim 2, in which said conical section comprises a truncated cone with a cone axis thereof aligned with said fluid throughflow axis, and with a base thereof downstream of an apex thereof.

4. A foam pump as claimed in claim 3 in which said fluid inlet is provided with an inlet valve comprising a resilient cone member mounted on a boss, in which said cone member comprises an outer rim, in which said outer rim is urged against an inner surface of said mixing chamber to shut the fluid inlet by a negative pressure generated during a priming stroke of said fluid cylinder, in which said outer rim is forced away from said inner surface to open the fluid inlet by a positive pressure generated during a dispensing stroke of said fluid cylinder, and in which an underside of said cone member comprises said conical section of said mixing chamber.

5. A foam pump as claimed in claim 4 in which said boss is mounted on a sleeve component provided in said mixing chamber, in which an aperture is formed between said boss and said sleeve component through which mixed air and fluid passes in use.

6. A foam pump as claimed in claim 5 in which the air cylinder is connected to said mixing chamber by an air passageway which extends from a first opening at a bottom of said air cylinder to said air inlet of said mixing chamber, in which said air passageway comprises a first portion which extends from said first opening to an intermediary opening in said inner surface of said mixing chamber, in which said sleeve component overlies said intermediary opening, in which said sleeve component comprises an annular trough in an outer surface thereof which is aligned with said intermediary opening and defines a second portion of said air passageway, and in which said sleeve component comprises a flat wasted section extending axially from said annular trough to an upper rim of said sleeve component and defining a third portion of said air passageway.

7. A foam pump as claimed in claim 1 further comprising a valve chamber comprising a primary fluid inlet and a primary fluid outlet, in which said primary fluid inlet and said primary fluid outlet are arranged on said fluid throughflow axis, in which the valve chamber and the mixing chamber are sequentially aligned on said fluid throughflow axis, and in which the fluid cylinder is in operative connection with said valve chamber.

8. A foam pump as claimed in claim 7 in which said primary fluid inlet is controlled by a primary fluid valve member adapted to open during a priming stroke of said fluid cylinder and to shut during a dispensing stroke of said fluid cylinder.

9. A foam pump as claimed in claim 8 in which the primary fluid valve member is a ball valve.

10. A foam pump as claimed in claim 1 in which the fluid cylinder and the air cylinder are co-axial with one another.

11. A foam pump as claimed in claim 10 in which said air cylinder is radially arranged around said fluid cylinder.

12. A foam pump as claimed in claim 11 in which the fluid cylinder and the air cylinder are provided with a common piston member comprising a fluid piston and an air piston, in which said fluid piston and said air piston are co-axial with one another and disposed in said fluid cylinder and said air cylinder respectively.

13. A foam pump as claimed in claim 12 in which said fluid piston and said air piston are self-sealing against the walls of said fluid cylinder and said air cylinder respectively.

14. A foam pump as claimed in claim 1 in which the air cylinder is provided with one or more apertures through which air from atmosphere is drawable, in which said one or more apertures are provided with a primary air valve member adapted to open during a priming stroke of said air cylinder and to shut during a dispensing stroke of said air cylinder.

15. A foam pump as claimed in claim 14 in which said one or more apertures are provided at the bottom of the air cylinder, in which said primary air valve member comprises a resilient annular disc disposed at the bottom of the air cylinder and overlying said one or more apertures, in which said annular disc is lifted away from the bottom of the air cylinder to open said one or more apertures by a negative pressure generated inside said air cylinder during a priming stroke thereof, and in which said annular disc is urged against the bottom of the air cylinder to shut said one or more apertures by a positive pressure generated inside said air cylinder during a dispensing stroke thereof.

16. A foam pump as claimed in claim 1 further comprising a foaming chamber, sequentially aligned on said fluid throughflow axis after said mixing chamber, in which said foaming chamber comprises one or more foaming meshes adapted to generate a foam to be dispensed from mixed fluid and air forced into the foaming chamber in use.

17. A foam pump as claimed in claim 12 in which the foam pump comprises spring means adapted to bias said common piston member to perform a priming stroke of the fluid cylinder and the air cylinder.

18. A foam pump as claimed in claim 17 in which said spring means comprises a coil spring disposed in said air cylinder and around said fluid cylinder, and which acts against said air piston.

19. A foam pump as claimed in claim 12 in which said piston member comprises an operating plunger provided with an operative depression surface at an outer end thereof.

20. A foam pump as claimed in claim 12 in which said piston member comprises an operating plunger provided with a substantially ball-shaped resilient sliding member at an outer end thereof.

* * * * *